United States Patent [19]

Watanabe et al.

[11] 4,403,910

[45] Sep. 13, 1983

[54] PUMP APPARATUS

[75] Inventors: Kiyohiko Watanabe, Chiryu; Kazuma Matsui, Toyohashi; Yoshiyuki Hattori, Toyoake; Toshihiro Takei, Kariya; Toshiaki Nakamura, Anjo; Shunaku Ohnishi, Toyota, all of Japan

[73] Assignee: Nippondenso Co., Ltd., Kariya, Japan

[21] Appl. No.: 372,377

[22] Filed: Apr. 27, 1982

[30] Foreign Application Priority Data

Apr. 30, 1981 [JP] Japan ..... 56-63071[U]

[51] Int. Cl.[3] ..... F04D 5/00

[52] U.S. Cl. ..... 415/53 T; 415/213 T; 416/184

[58] Field of Search ..... 222/368; 366/150; 415/53 R, 53 T, 54, 55, 56, 57, 58, 59, 213 T; 416/184, 199

[56] References Cited

U.S. PATENT DOCUMENTS

| | | | |
|---|---|---|---|
| 1,865,396 | 6/1932 | Claypool | 415/213 T |
| 1,893,616 | 1/1933 | Ferguson | 415/213 T |
| 3,658,444 | 4/1972 | Rhodes et al. | 415/213 T |

*Primary Examiner*—Harvey C. Hornsby
*Assistant Examiner*—Arthur D. Dahlberg
*Attorney, Agent, or Firm*—Cushman, Darby & Cushman

[57] ABSTRACT

A regenerative pump apparatus has a housing and a substantially disc-shaped impeller rotatably housed by the housing. Circumferential rows of radial vane grooves are formed in the outer peripheral portions of both side surfaces of the impeller. Each circumferential row includes first vane grooves of an axial depth equal to or greater than a half of the impeller thickness and second vane grooves of an axial depth smaller than a half of the impeller thickness. The first and second vane grooves are arranged alternatingly in the circumferential direction in each row, such that the first vane grooves and the second vane grooves in one row are axially aligned with the second vane grooves and the first vane grooves in the other row.

1 Claim, 13 Drawing Figures

PUMP APPARATUS

BACKGROUND OF THE INVENTION

1. Field of the Invention

The present invention relates to a pump apparatus for pumping, for example, fuel from a fuel tank on a vehicle to an engine mounted on the vehicle.

2. Brief Description of the Drawings

DESCRIPTION OF THE PRIOR ART

Various types of pump have been used hitherto in the field of pumps of the kind mentioned above, such as roller pump as volume type pump, axial flow pump as centrifugal pump and open-vane pump as regenerative pump.

The volume type pump is operable at a high discharge pressure of about 2 to 3 $Kg/cm^2$ and a high efficiency. For attaining satisfactory performance with this type of pump, however, the production cost of the pump is raised uneconomically due to the requirement for a high precision of assembling. In addition, this type of pump suffers the problems of high levels of noise, vibration and pulsation of the discharge pressure.

It is difficult to obtain the high discharge pressure of 2 to 3 $Kg/cm^2$ with the centrifugal pump. The regenerative pump of open-vane type also fials to provide the high discharge pressure of 2 to 3 $Kg/cm^2$ and suffers an impractically low efficiency.

Figure 5:
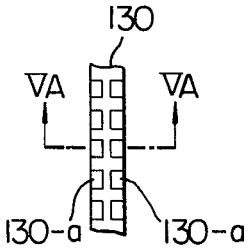
FIG. 5 is a fragmentary side elevational view of a conventional impeller.
Figure 5A:
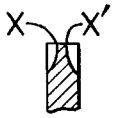
FIG. 5A is a sectional view taken along the line VA—VA of FIG. 5.
Figure 6:
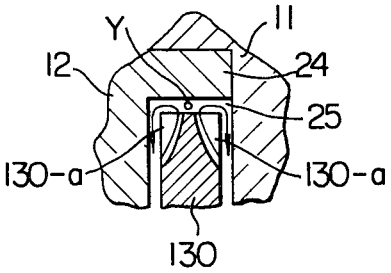
FIG. 6 is a fragmentary enlarged sectional view of a pump incorporating the impeller shown in FIG. 5, illustrating particularly the state of flow of a fluid around a third seal section of the pump.

In the known regenerative pump of closed-vane type, each of the vane grooves of impeller comprises such a cross-sectional shape that the thickness of the impeller is gradually decreased radial outwardly and the vane grooves formed in both sides of the impeller have an equal shape, i.e. an equal axial vane depth, as will be seen from FIG. 5A. Referring to FIGS. 5A and 6, the point of intersection between the bottom of the vane groove in one side of the impeller and the peripheral surface of the impeller is indicated by X, while the corresponding point of intersection on the other side of the impeller is also indicated by X'. The portion (represented by Y in FIG. 6) of the fluid passage facing the peripheral surface portion X–X' is not influenced by the flow of the fluid in the vane grooves because of the symmetric arrangement of the vane grooves. This portion of the fluid passage will be referred to as "no eddy current portion" hereinunder. The no eddy current portion Y exists in the closely proximity of the outer peripheral surface of the impeller and extends circumferentially to completely surround the impeller. The no eddy current portion Y, therefore, extends circumferentially also across a partition which intercepts the circumferential fluid passage to separate the discharge side of high pressure and the suction side of low pressure from each other. In consequence, the high pressure undesirably leaks from the discharge side to the suction side through the no eddy current portion Y extending circumferentially across the partition. The discharge pressure of the pump, therefore, is reduced and the pump efficiency is lowered disadvantageously. This fact has been confirmed through experiment conducted by the present inventors employing impellers having large peripheral surface portion X—X mentioned before.

SUMMARY OF THE INVENTION

Accordingly, an object of the invention is to provide a pump operable at a high discharge pressure and a high pump efficiency while suppressing the noise, vibration and the pulsation of discharge pressure, thereby to overcome the above-described problems of the prior art.

To this end, the pump apparatus of the invention employs a regenerative pump of closed-vane type which can ensure a high discharge pressure of 2 to 3 $Kg/cm^2$ and a high pump efficiency, as well as reduced noise, vibration and pulsation. The term "regenerative pump of closed vane type" used throughout mean a regenerative pump in which the bottom face of each of radial vane grooves formed in one side faces of a disk-like impeller does not intersect with the bottom face of an aligned radial vane groove formed in the other side face of the impeller. In addition, according to the invention, the impeller is provided with a first circumferential row of radial vane grooves formed in the outer peripheral portion of one side surface thereof and a second circumferential row of radial vane grooves formed in the outer peripheral portion of the other side surface of thereof, each row including first radial vane grooves each having an axial depth as measured at the outer peripheral surface of the impeller equal to or greater than a half of the impeller thickness and second radial vane grooves each having an axial depth as measured at the outer peripheral surface smaller than a half of the impeller thickness, the first vane grooves and the second vane grooves being arranged alternatingly in each row, in such a manner that the first and second vane grooves in the first row are axially aligned with the second and the first vane grooves of the second row, respectively. In consequence, the aforementioned portion Y is extinguished to eliminate the loss of discharge pressure and, hence, the pump efficiency is improved.

DESCRIPTION OF THE PREFERRED EMBODIMENTS

Figure 1:
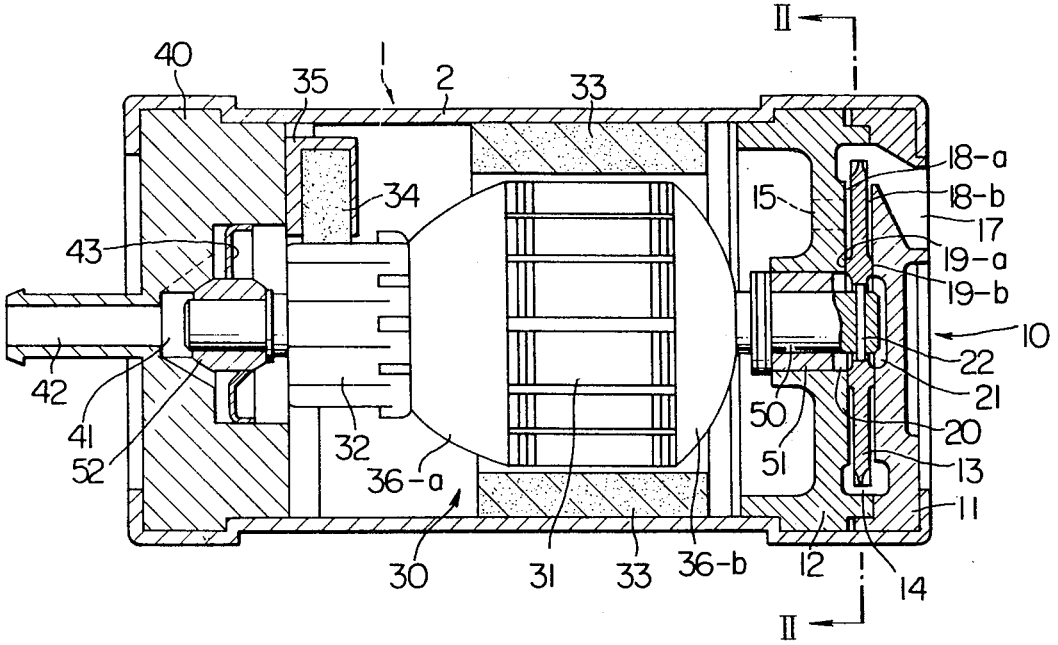
FIG. 1 is a longitudinal sectional view of a pump apparatus incorporating a pump of an embodiment of the invention.
Figure 2:
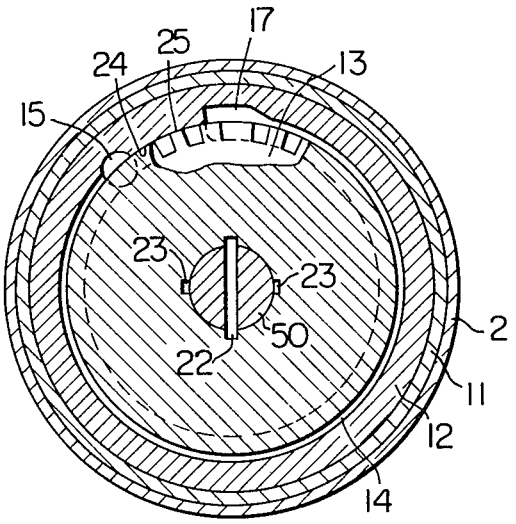
FIG. 2 is a sectional view taken along the line II—II of FIG. 1.

An electrically operated fuel pump device will be described hereinunder as an embodiment of the present invention with reference to the accompanying drawings. Referring to FIGS. 1 and 2, the fuel pump apparatus generally designated at a reference numeral 1 has a casing 2 accomodating a pump 10 and a motor 30. The pump 10 has an impeller rotatably disposed in a pump housing composed of an inlet housing part 11 and an outlet housing part 12. The inlet housing part 11 and the outlet housing part 12 are fixed to the inside of the casing 2 by curling. The inlet housing part 11 is provided with a suction port 17, while the outlet housing part 12 is provided with a discharge port 15. The outlet housing part 12 acts also as a holder for a first bearing 51 which rotatably carries one end of a shaft 50.

An impeller 13 is mounted on the shaft 50 for axial sliding movement. The transmission of the torque from the shaft 50 to the impeller 13 is performed by a pin 22 fitting in a hole formed in the shaft 50.

Figure 3:
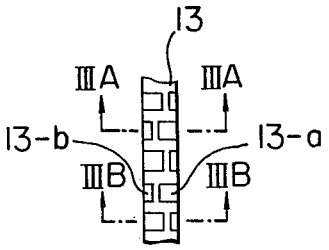
FIG. 3 is a fragmentary side elevational view of an impeller incorporated in the pump shown in FIG. 1.
Figure 3A:
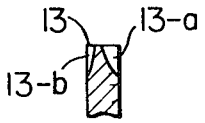
FIGS. 3A and 3B are sectional views taken along the lines IIIA—IIIA and IIIB—IIIB of FIG. 3, respectively.
Figure 3B:
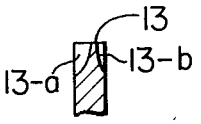

According to the invention, as will be clearly seen from FIGS. 3, 3A and 3B, the impeller 13 is provided with a first circumferential row of radial vane grooves formed in the outer peripheral portion of one side surface thereof and a second circumferential row of radial vane grooves formed in the outer peripheral portion of the other side surface thereof. Each row includes first vane grooves 13-*a* having an axial depth as measured at the outer peripheral surface of the impeller equal to or greater than a half of the impeller thickness and second vane grooves 13-*b* having an axial depth as measured at the outer peripheral surface smaller than the half of the impeller thickness. In each circumferential row of the vane grooves, the first vane grooves and the second vane grooves are disposed alternatingly in such a manner that the first vane grooves and the second vane grooves in the first row are axially aligned with the second vane grooves and the first vane grooves of the second row, respectively. A substantially annular fluid passage 14 is defined in the pump 10 by the impeller 13, inlet housing part 11 and the outlet housing part 12. This fluid passage 14 is communicated with the suction port 17 and the discharge port 15 which are mentioned before. As will be clearly seen from FIG. 2, the suction port 17 and the discharge port 15 are circumferentially spaced from each other. A partition wall 24 interrupts the fluid passage 14 circumferentially.

A plurality of grooves 23 for transmitting pressure are formed on the inner peripheral wall defining the shaft bore of the impeller 13, so that a balance of pressure is always maintained between the pump chambers 20 and 21 defined at both sides of the impellr 13.

A first seal section 18-*a*, 18-*b* and a second seal section 19-*a*, 19-*b* provide seal betwen both housing parts and the opposing side surfaces of the impeller as illustrated, thereby to effectively prevent the fluid passage 14 from being communicated with the pump chambers 20 and 21. More specifically, the side clearances in the second seal section 19-*a*, 19-*b* is smaller than that in the first seal section 18-*a*, 18-*b*. Thus, the second seal section rules the side clearance in the first seal section and effectively prevents the peripheral edge portion of the impeller 13 from being damaged due to contact with stationary part attributable to an offset of the impeller.

A third seal section 25 provides a seal between the outer peripheral surface of the impeller 13 and the opposing surface of the partition wall 24. This third seal section 25 effectively prevents the undesirable leak of pressurized fuel from the discharge port 15 to the suction port 17 through the partition wall 24.

An explanation will be made hereinunder as to the construction of the motor 30. Referring back to FIG. 1, the motor 30 has a permanent magnet 33 fixed to the inner surface of the casing 2. An armature 31 is mounted on the portion of the shaft 50 opposing to the permanent magnet 33. A commutator 32 is attached to the portion of the shaft 50 adjacent to and is electrically connected to the armature 31. Capsules 36-*a*, 36-*b* having smooth spherical surfaces are attached to both ends of the armature 31 to decrease the frictional resistance imposed on the armature 31 by the fluid during operation of the motor.

A bearing holder 40 which may be considered as an end wall is fixed to the inner surface of end portion of the casing 2 by curling. The bearing holder 40 is provided with a discharge passage 41 and a discharge port 42 which are in communication with each other. The bearing holder 40 carries brush holders 35 holding brushes 34 and, in addition, cooperates with a lock washer 43 to hold a second bearing 52. The bearing 52 supports the other end of the shaft 50.

The fuel pump apparatus having a described construction operates in a manner explained hereinunder.

The armature 31 starts to rotate together with the impeller 13 as it is supplied with electric power from a power supply (not shown) through the brushes 34 and the commutator 32. In consequence, the fuel is introduced through the suction port 17 and is pressurized gradually up to 3 to 4 $Kg/cm^2$ as it flows circumferentially through the fluid passage 14 and is discharged into the space in the motor 30 via the discharge port 15. The pressurized fuel effectively cools the armature 31 as it flows through the gap between the armature 31 and the permanent magnet 33 in the motor 30, and is finally discharged via the discharge passage 41 from the discharge port 42.

Figure 4:
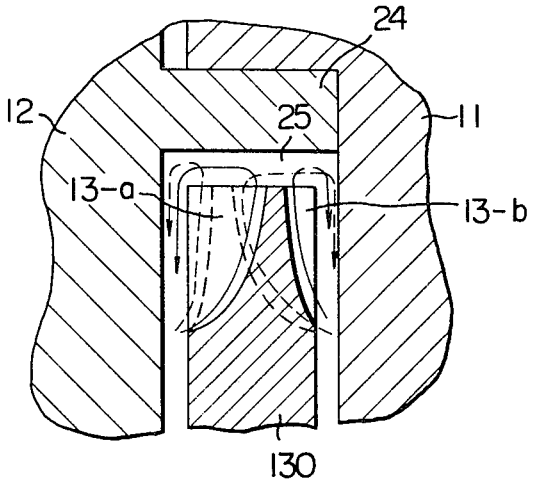
FIG. 4 is a fragmentary enlarged sectional view of a pump incorporating the impeller shown in FIG. 3, illustrating particularly the state of flow of a fluid in the area around a third seal section of the pump.

The state of flow of the fuel around the third seal section 25 will be explained hereinunder. FIG. 4 illustrates the state of flow of fuel in the vane grooves in the impeller of the invention shown in FIG. 3. As will be seen from this Figure, the fuel flows as indicated by solid line arrows and broken line arrows through the third seal section 25, so that the no eddy current portion which is continuous circumferentially around the impeller or free from the influence of the flow of fuel in the vane grooves 13-*a* and 13-*b*, is never formed. In consequence, the pressure leak from the discharge port 15 to the suction port 17, i.e. the loss of pressure, is remarkably decreased to further improve the pump efficiency.

FIG. 6 shows the state of flow of fuel in the third seal section 25 in the pump incorporating the known impeller 130 shown in FIG. 5. As indicated by the arrow, the fuel does never flow dynamically into the portion Y facing the portion X–X' in the third seal section 25. Thus, the portion Y is never influenced by the flow of fuel in the vane grooves. This portion Y exists continuously in the circumferential direction around outer peripheral surface of the impeller and extends also across the third seal section 25. In consequence, the pressure leaks from the high pressure portion around the discharge port 15 to the low pressure portion around the suction port 17 to lower the efficiency of the pump unfavourably.

Figure 7A:
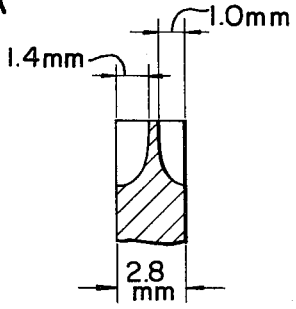
FIGS. 7A and 7B are fragmentary sectional views of vane grooves in impellers employed in an experiments of comparing the performance of the pump of the present invention and of a conventional pump.
Figure 7B:
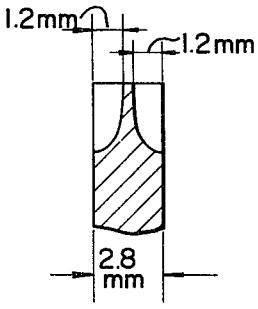
Figure 8:
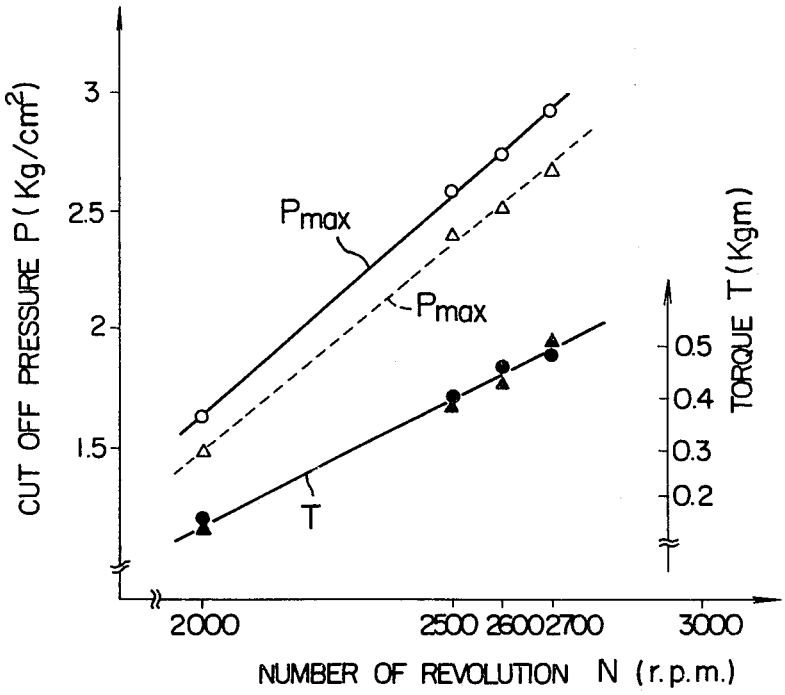
FIGS. 8 and 9 are graphs illustrating the results of the experiments.
Figure 9:
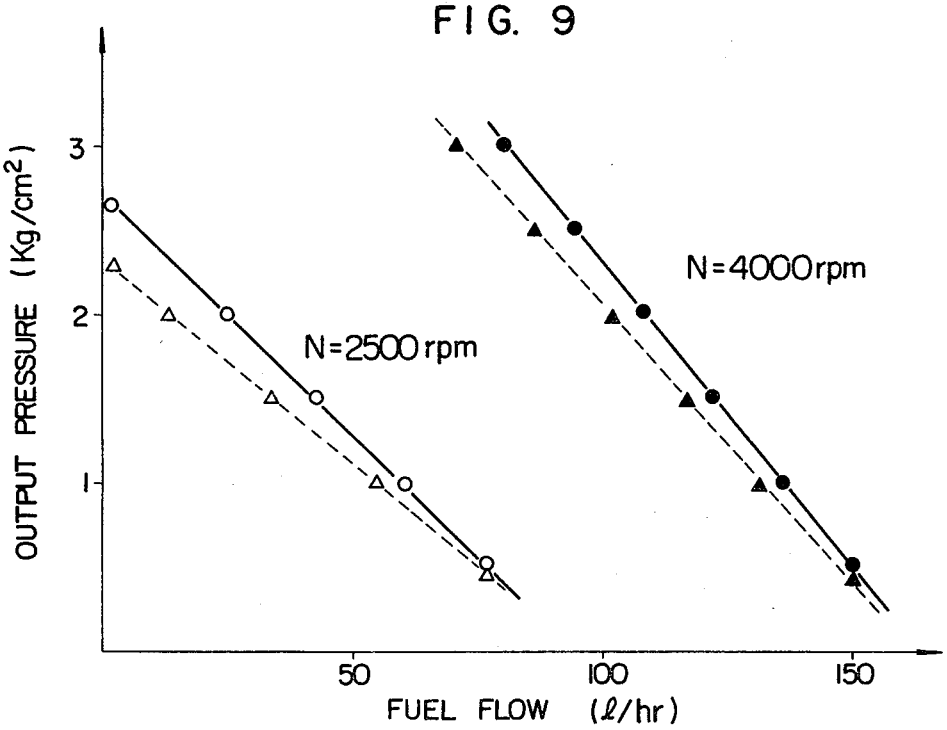

In order to confirm the advantage of the invention, the present inventors have conducted an experiment using impellers as shown in FIGS. 7A and 7B to obtain a result as shown in FIGS. 8 and 9. More specifically, FIG. 7A shows an impeller in accordance with the invention in which the first vane groove in each circumferential row has an axial depth of 1.4 mm amounting to a half of the impeller thickness as measured at the outer peripheral surface of the impeller while the second vane groove has an axial depth of 1.0 mm. The first and the second vane grooves are arranged alternatingly and circumferentially in the manner as shown in FIG. 3. On the other hand, in the known impeller shown in FIG. 7B, the circumferential rows of vane grooves are formed in symmetry with respect to the thicknesswise bisector of the impeller and each row includes a plurality of identical vane grooves having an axial depth of 1.2 mm which is smaller than a half of the impeller thickness of 2.8 mm.

FIG. 8 shows the performance of the pump of the invention in comparison with that of the conventional pump. More specifically, FIG. 8 shows the required driving torque and the cut-off pressure (maximum pressure reached when the discharge port 42 is closed) in relation to the revolutions of the pump. The performance of the conventional pump is marked at Ⓐ and ▲, while the performance of the pump of the invention is indicated at ○ and ●, respectively. From FIG. 8, it will be seen that the pump of the invention performs a cut-off pressure which is about 8% higher than that of the conventional pump, although the required driving torques are substantially equal.

FIG. 9 shows the performance of the pump in accordance with the invention in comparison with that of the conventional pump. More specifically, FIG. 9 shows how the discharge pressures are changed in these pumps in relation to the discharge rate at the revolutions of the pump of 2500 r.p.m. and 4000 r.p.m. The performance of the conventional pump is marked at Ⓐ and ▲, while the performance of the pump of the invention are indicated at ○ and ●, respectively. From this Figure, it will be understood that the pump of the invention provides higher discharge pressure than the conventional pump. Thus, the pump apparatus in accordance with the invention performs pump performance much superior to that of the conventional pump apparatus.

As has been described, in the pump apparatus of the invention, a high discharge pressure of 2 to 3 $Kg/cm^2$ is attained simultaneously with high efficiency, while suppressing the noise, vibration and pulsation remarkably, thanks to the use of the regenerative pump of closed-vane type. In addition, the leak of pressure from the discharge portion to the suction portion, i.e. the loss of pressure, is restrained to ensure a further improvement in the pump efficiency, owing to the specific arrangement of vane grooves in the impeller as explained before.

Although the invention has been described through a specific embodiment applied to an electrically operated fuel pump, it is to be understood that the described embodiment is not exclusive and the invention can apply to a large variety of pumps for pumping fluids.

What is claimed is:

1. A pump apparatus comprising:

a regenerative pump means, means operatively connected to said pump means for driving said pump means, said pump means including a pump housing and a closed vane type impeller rotatably housed in said pump housing, said pump housing cooperating with said impeller to define a substantial circumferential fluid passage surrounding outer peripheral portion of said impeller, said pump housing provided therein with suction and discharge ports circumferentially spaced from each other and communicated with said circumferential fluid passage, means disposed in said circumferential fluid passage between said suction and discharge ports to provide a circumferential seal therebetween, said impeller having a substantially disc-like shape and provided with circumferential rows of radial vane grooves in side faces of said impeller adjacent to the outer peripheral surface thereof, each of said circumferential rows comprising first vane grooves each of which has a depth at the outer peripheral surface equal to or greater than a half of the impeller thickness and second vane grooves each of which has a depth at the outer peripheral surface less than a half of the impeller thickness, said first vane groove circumferentially alternating with said second vane groove in each of said rows and axially aligning with said second vane groove.

* * * * *